United States Patent [19]

Pisano

[11] 4,205,318

[45] May 27, 1980

[54] MINI-INDOOR TV ANTENNA

[76] Inventor: Vincent F. Pisano, 654 NE. 56th St., Miami, Fla. 33137

[21] Appl. No.: 3,588

[22] Filed: Jan. 15, 1979

[51] Int. Cl.[2] ..... H01Q 9/26

[52] U.S. Cl. ..... 343/741; 343/895

[58] Field of Search ..... 343/741, 803, 788, 749, 343/787, 750, 842, 895

[56] References Cited

U.S. PATENT DOCUMENTS

| | | | |
|---|---|---|---|
| 167,457 | 8/1852 | Gordon | 343/803 |
| 1,495,537 | 5/1924 | Stafford | 343/895 |
| 1,673,458 | 9/1925 | Jones | 343/749 |
| 2,636,986 | 4/1953 | Riderman | 343/750 |
| 2,763,003 | 9/1956 | Harris | 343/895 |
| 2,769,148 | 10/1956 | Clogston | 343/787 |
| 2,895,129 | 7/1959 | Kamen et al. | 343/787 |
| 3,573,840 | 4/1971 | Gouillou | 343/895 |

*Primary Examiner*—David K. Moore
*Attorney, Agent, or Firm*—Gustave Miller

[57] ABSTRACT

An indoor antenna of small dimensions provided by an inductance coil encompassing a non-magnetic metal cylinder and having a sheet of non-magnetic metal foil wrapped thereabout. The antenna is housed in a small container, the largest dimension of which may be less than six inches.

8 Claims, 3 Drawing Figures

MINI-INDOOR TV ANTENNA

This invention relates to an antenna of small size for receiving radiation electromagnetic waves, especially those in the range of frequencies used in the television band.

It is highly desirable that an indoor television antenna be so constructed as to be capable of efficiently receiving television signals and yet be as small as possible so as to fit in a restricted space. If small enough it can be hidden from view or housed in an ornamental container and located anywhere in a room including the top of a television cabinet to form an article of adornment in addition to its utilitarian purpose. Such an antenna could do away with the unsightliness of the rabbit ears usually employed indoors and replace the roof top antennas which are expensive, unsightly and subject to deterioration due to weather.

It is therefore an object of the invention to provide an efficient indoor antenna of such dimension as to be much shorter than the wavelengths of the usual television signals and yet be capable of receiving the whole range of such signals.

It is a further object of the invention to provide an antenna for receiving television signals of such small dimensions as to be capable of being hidden in a small container and not exposed to view.

It is another object of this invention to provide a television antenna of small dimension and light weight, which is simple in construction, can be produced economically and rendered tamper proof.

The antenna according to my invention is in the form of a wound coil having anywhere between 24 to 40 turns of No. 18 aluminum wire but being preferably 29 turns. Nested within the coil is a non-magnetic metal cylinder closed at one end by the material thereof. A non-magnetic metal foil sheet is wrapped about the coil, but insulated therefrom by an interface sheet or layer of electrical insulating material. One output lead from the antenna is taken from the metal foil sheet which is preferably adjacent the open end of the metal cylinder. The other antenna output lead is taken from adjacent the end of the coil which is in turn connected to one end of the metal cylinder. One end of the coil remains unattached.

A full and detailed description of the various parts of the invention, the manner in which they are assembled and electrically connected now follows with specific reference to the Figures of the drawing wherein.

Figure 1:
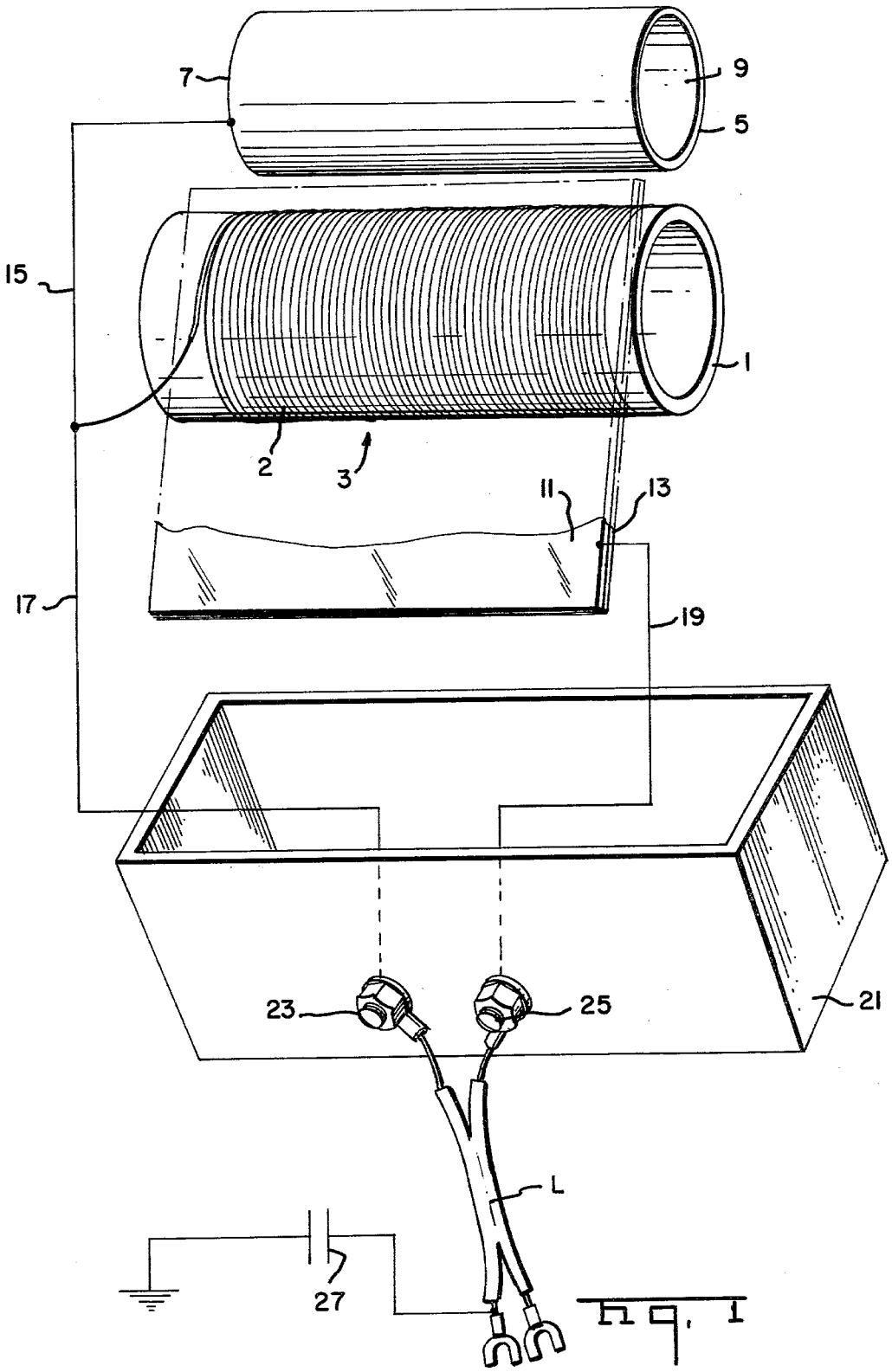
FIG. 1 is a disassembled view of the various components electrically connected together.
Figure 2:
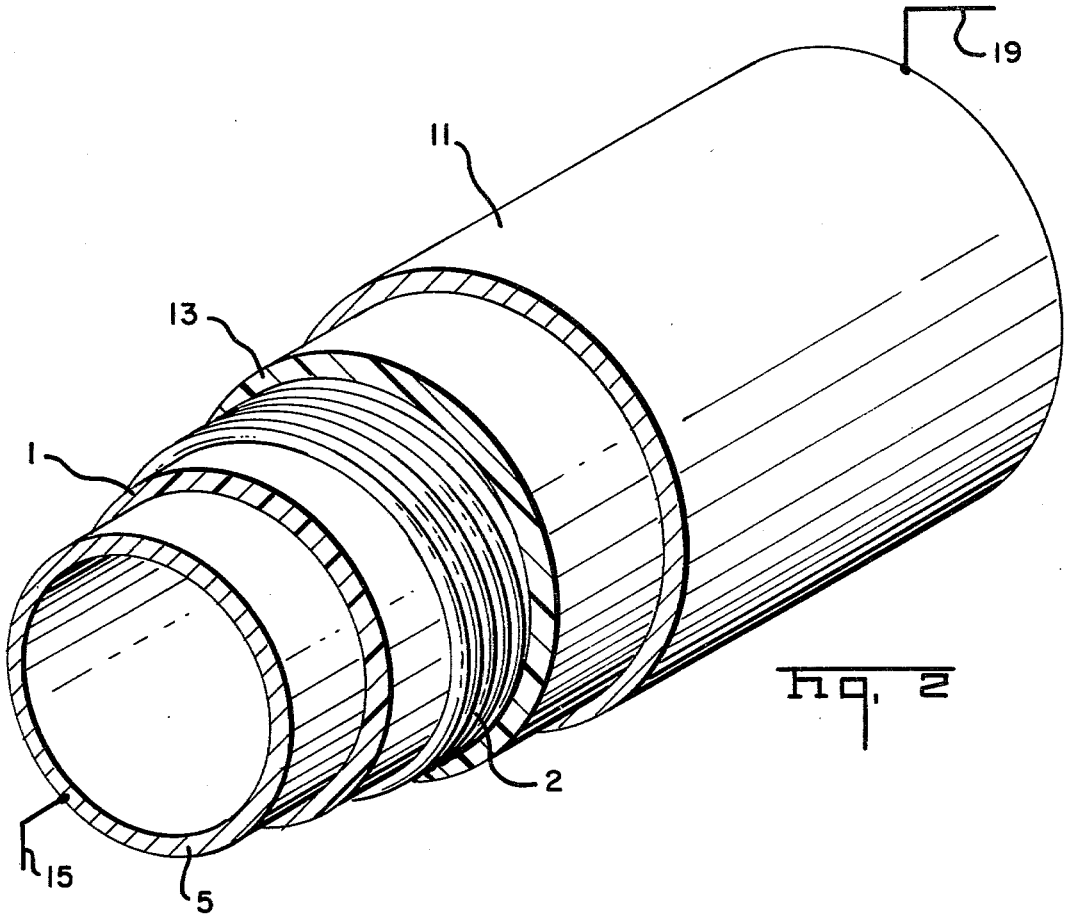
FIG. 2 shows the antenna in perspective with the components of FIG. 1 is assembled relation.
Figure 3:
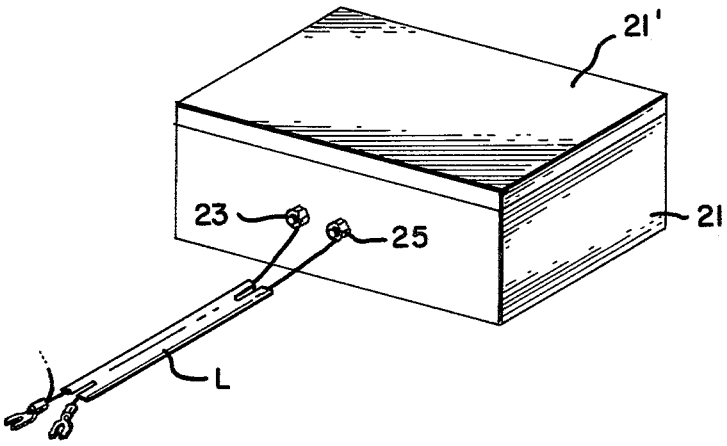
FIG. 3 shows a sealed container within which the antenna is housed.

Firstly, there is provided a rigid hollow cylindrical form 1 of electrically insulating material of plastic or cardboard upon which is wound a bare electrical conductor 2 to form a coil 3. The number of turns of the thus formed coil 3 are optionally 29 turns but may very between 24 and 40 without significantly decreasing the effectiveness of the antenna. The turns of the conductor are very close to each other but not in direct electrical contact. Nested snugly within the cylindrical form 1 is a hollow metal cylindrical member 5 of non-magnetic material, such as aluminum, which is closed at one end 7 by the material thereof and open at its opposite end 9. A sheet 11 of non-magnetic metal foil, such as aluminum and provided with a layer of electrical insulation material 13 on its inner surface is wrapped tightly about the coil 2. Instead of such layer of insulating material 13 being carried by the sheet 11, the coil 3 may first be covered with an insulating sheet or a layer of insulating varnish and the foil sheet 11 then wrapped about insulating material. Of course, the wire forming the coil 3 may initially have a thin coating or covering of insulation, thus obviating the need for the insulation sheet 13 or the insulating varnish.

The foil 11 may be held to the form 1 in any desired manner, as by gluing together the overlapping margins thereof or by adhesive bands, such as "Scotch" tape thereabout. The end of the conductor 2 of the coil 3 adjacent to the closed end 7 of the cyindrical member 5 is electrically connected to such member adjacent the closed end 7 by a conductor 15. A lead 17 is connected to the conductor 15 and a second lead 19 connected to the foil sheet 11, preferably at a location adjacent to the open end of the form 1.

The entire assembly as above described is housed in a container 21 of insulating material transparent to electromagnetic waves. One wall of the container is provided with a pair of electrical contact pins 23, 25 which extend therethrough. Before the antenna, assembled as above, is placed in the container 21, the leads 17, 19, forming the output terminals of the antenna are electrically secured to the contact pins 23, 25 interiorly of the container. After placing the antenna within the container 21, the latter is closed by a cover 21' which may be sealed thereto so as to prevent entry of moisture and dirt and to render the contents tamper-proof.

In one practical form of the antenna of my invention, the insulating cylinder 1, on which the coil 2 is wound with 18 guage wire, has an inner diameter of about 2 9/16 inches and a thickness of about 1/32 of an inch. The metal cylinder 5 has a diameter of about 2½ inches for nesting snugly within the insulating cylinder 1 and is of substantialy the same length. The entire assembly can be housed in a box, such as shown at 21, having outer dimensions as small as 4⅝×3⅛×3⅛ inches. In use, one of the leads L, which is connected to an input terminal of the television set is grounded to the chassis thereof through an isolating condenser 27. The connections of the leads to the inut terminals of a television set may be reversed for best results. It has been found in use that the antenna above described gives remarkably good results in intercepting and transmitting to the television set the full range of signals and in this regard compares favorably with the usual rabbit ears and even with the conventional roof-top antenna. It has been found that with the above described antenna, noise in the picture due to lightning and overhead aircraft are minimized to a great degree.

Having thus described the invention with the particularity required by the statutes, it is understood that obvious changes may be made by persons skilled in the art without departing from the spirit and scope of this invention as defined by the following claims.

What is claimed is:

1. An antenna for receiving signals in the television band, comprising:

a conductor wound about a linear axis to form an elongated helix, an elongated hollow cylindrical member of non-magnetic metal located within said helix in non-contacting relation with said conductor and extending substantially the length thereof, said cylindrical member being closed at one end by a plate of non-magnetic metal, one end of said conductor being electrically connected to said cylindrical member adjacent said closed end, a layer of electrical insulating material supported by said helix, a metallic foil sheet wrapped directly about said insulating layer, a first electrical terminal connected to said one end of the conductor, and a second electrical terminal connected to the foil.

2. An antenna according to claim 2 wherein said one end of the conductor is adjacent the closed end of the cylindrical member.

3. An antenna according to claim 2 wherein said conductor is wound on a rigid form of electrical insulating material.

4. An antenna according to claim 3 including a container of insulating material housing said antenna, a pair of contacts extending through a wall of said container, and respectively connected to said terminals.

5. An antenna according to claim 4 wherein said housing is sealed.

6. An antenna according to claim 1 wherein said conductor is wound on a rigid form of electrical insulating material, the turns of the helix being closely adjacent each other.

7. An antenna according to claim 5 wherein said helix comprises 24 to 40 turns of No. 18 wire.

8. An antenna according to claim 1 wherein said second electrical terminal is connected to the foil at a location adjacent the open end of said cylindrical member.

* * * * *